US007121224B2

(12) United States Patent
Saarelainen

(10) Patent No.: US 7,121,224 B2
(45) Date of Patent: Oct. 17, 2006

(54) ANCHOR ASSEMBLY

(76) Inventor: Pentti Saarelainen, Insinöörinkatu 88 B, FI-33720 Tampere (FI)

( * ) Notice: Subject to any disclaimer, the term of this patent is extended or adjusted under 35 U.S.C. 154(b) by 0 days.

(21) Appl. No.: 10/543,614

(22) PCT Filed: Jan. 30, 2004

(86) PCT No.: PCT/FI2004/000045

§ 371 (c)(1),
(2), (4) Date: Jul. 28, 2005

(87) PCT Pub. No.: WO2004/067371

PCT Pub. Date: Aug. 12, 2004

(65) Prior Publication Data

US 2006/0070566 A1 Apr. 6, 2006

(30) Foreign Application Priority Data

Jan. 30, 2003 (FI) ..... 20030136

(51) Int. Cl.
*B63B 21/46* (2006.01)

(52) U.S. Cl. ..... 114/299

(58) Field of Classification Search ..... 114/299
See application file for complete search history.

(56) References Cited

U.S. PATENT DOCUMENTS 1,899,866 A 2/1933 Harvey
2,413,596 A 12/1946 Hood, Jr.
2,764,116 A * 9/1956 Brewer ..... 114/299
3,030,907 A 4/1962 Rosselle
3,150,629 A * 9/1964 Fields ..... 114/299
3,841,255 A * 10/1974 Mansfield ..... 114/299
4,019,455 A 4/1977 Hungerford
4,397,257 A 8/1983 Colin
4,523,539 A * 6/1985 Granger ..... 114/299
6,155,194 A 12/2000 Hoareau
6,209,475 B1 4/2001 Powell

* cited by examiner

*Primary Examiner*—Stephen Avila
(74) *Attorney, Agent, or Firm*—Stites & Harbison PLLC; Douglas E. Jackson

(57) ABSTRACT

An assembly used in connection with an anchor, whereby, on use, the anchor comprises one or more endpieces (2) meant to penetrate into the bottom, a shank (1) from the endpiece, and fitted to the shank end a fixing holding block (8) furnished with a hole for the pulling element of the anchor. The mounting holding block (8) or similar of the pulling element is fitted to piece (9) movable along shank so that on anchoring the motion of piece (9) from shank (1) end towards endpiece (2) is prevented by a blocking arrangement (7,11) between shank (1) and the piece and lifting the anchor on use the impact of the locking arrangement is eliminated.

5 Claims, 1 Drawing Sheet

ANCHOR ASSEMBLY

The invention relates to an assembly used in connection with an anchor, whereby the anchor comprises on use one or more endpieces meant to penetrate into the bottom, a shank from said endpiece, and fitted to the shank end a fixing means, as a holding block furnished with a hole for the anchor-pulling element, whereby the holding block or similar of the pulling element is fitted to a piece movable along the shank, which can turn around the shank, at least in the end of the shank.

Previously known are anchors like the presented ones among other things from U.S. Pat. Nos. 1,899,866, 3,030,907, 4,019,455, 4,397,257, 6,155,194 and 6,209,475. In the last mentioned publication an anchor is described, the pull-point of whose chain is on use in the anchor shank end and on lifting up the anchor the pull-point can be triggered off, whereby the pull-point of the anchor chain moves to the other shank end. Also in the solutions of the other publications on lifting up the pull-point is, one way or another, moved from shank end to the butt of the shank.

To secure the anchor lift-up a solution is known, where on lifting the pull-point is shifted from one shank end to the other shank end, that is quite close to the anchor hooks, that is plough like organs or similar endpieces that penetrate the ground. The most simple shift of the pull-point takes place so that a separate lifting rope or similar is fixed to one anchor end, by means of which the anchor is lifted up or at least pulled off the bottom.

This solution requires two separate ropes for instance per anchor. Using two ropes is troublesome, and it is easily decided to leave out the lifting rope. Then it is relied that in driving over the anchor in the opposite direction, it can be got up pulling it with the real anchor cable. This solution does not always work and often the anchor has to be left in the bottom in breaking the anchor rope.

A solution as per U.S. Pat. No. 6,209,475 is not reliable, since it includes sensitive mechanics for trigging-off the pull-point. The solution also always requires re-tuning of the locking before the anchor is ready for next let-down. When the let-down does not turn out well the anchor has to be lifted up completely and the locking re-tuned.

By means of the assembly in connection with the anchor as per this invention the problems on using an anchor are solved and the invention is characterized in that on anchoring the motion of the piece from shank end towards the endpiece is prevented by turning of the piece, due to gravitation, in the shank into an angle position blocking the said motion, and, on lifting the anchor by turning the piece into an angle position, where the holding block is upwards, the motion of piece towards the endpiece is possible.

The advantage of the assembly according to this invention is that no separate lifting rope is needed to secure the pulling of anchor off the bottom. The anchor works reliably by use, even by varying wind directions, with the pull-point remaining in the anchor shank end. On pulling the anchor and driving over it in the opposite direction, the pull-point travels by itself to the other end of the shank. In the assembly no easily tearing or rusting mechanical triggers are needed. When the anchor has got off the bottom it turns immediately in the right direction and the pull-point returns to the end of the shank.

In the following the invention is disclosed with reference to the enclosed drawing, where FIG. 1 is a side view of the anchor.

Figure 1:
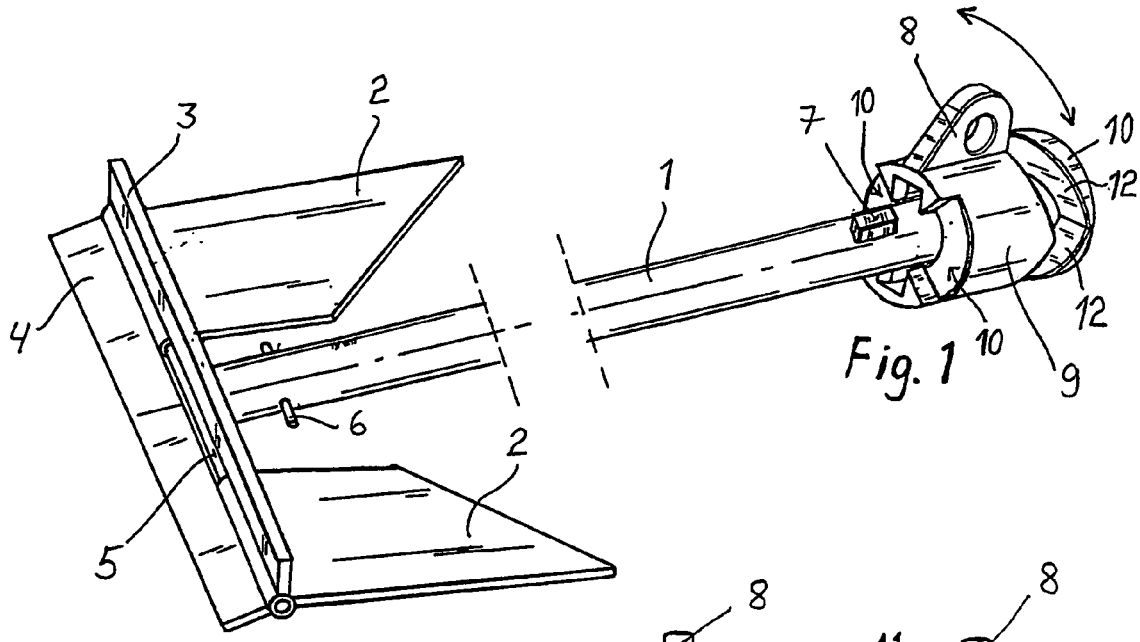
Figure 2:
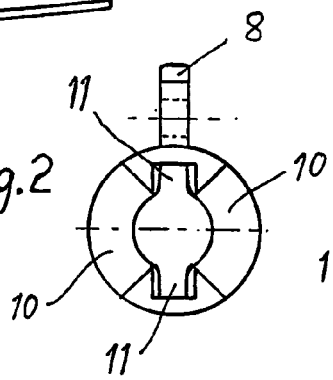
FIG. 2 is the moving fixing piece viewed from the end.
Figure 3:
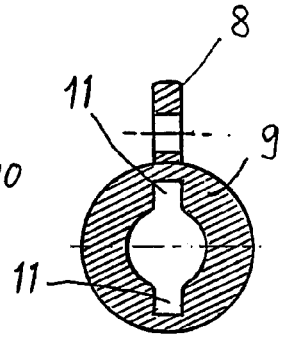
FIG. 3 is the moving fixing piece crosscut along line III—III.

FIG. 1 shows an anchor comprising a shank 1, a piece 9 fixed in the shank end, the piece having a holding block 8 with a hole for the anchor chain, and in the other shank end there are elements to stick to the bottom, which are two beak plough plates 2. Furthermore, there are in the said end supporting plates 3 and 4 for dropping the anchor to the bottom in the direction of both of them, and both supporting the anchor rear end so that the tips of plates 2 can sink better into the bottom. Shank 1 is fixed to supporting plates 3,4, which turn by means of axle 5, whereby pulling from shank 1 does not hinder sinking of the tips plates 2 into the bottom. Piece 9 can freely rotate in the end of shank 1. The free travel of the piece along shank 1 to the other shank end is prevented by means of stopper 7. However, piece 9 can in some angle position move to the other end of the shank. This angle position is formed, when groove 11, in connection with the inner hole of piece 9, is at stopper 7. Most advantageously there are two grooves 11, whereby the anchor can be turned even 180° in regard to piece 9. When the anchor by use is in the bottom as per FIG. 1, the chain fixed to holding block presses the holding block to the side and turns piece 9 likewise, even if the pulling direction from the chain would change. The stopper 7 prevents piece 8 from gliding along the shank and the pulling point remains in the shank end.

Figure 4:
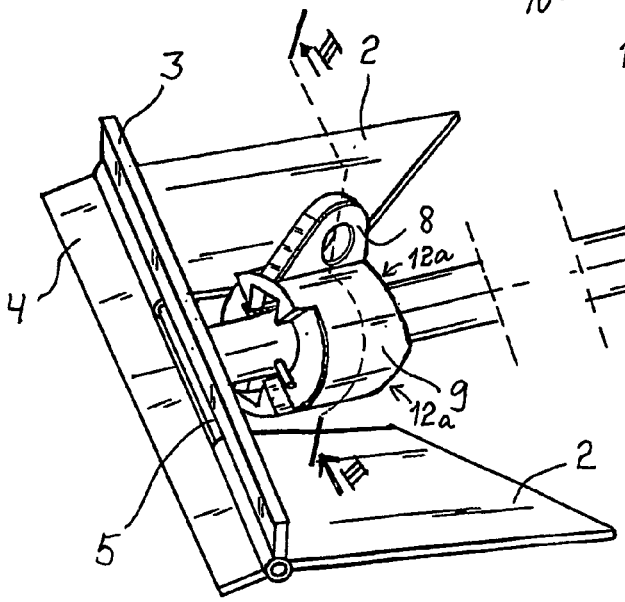
FIG. 4 is a side view of the anchor in lift-up position.
Figure 4:
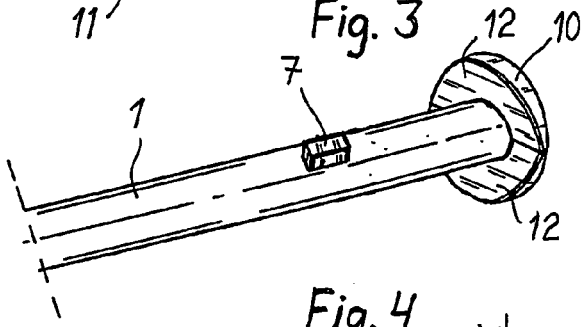

On lifting up the anchor, then one has to drive over the anchor place by boat in the opposite direction. The anchor rope must be kept tight, and when the boat is almost above the anchor, piece 9 turns so that holding block 8 is upwards and groove 11 of piece 9 lands at stopper 7. When moving on by boat, piece 8 glides to the other end of the shank against stoppers 6, as shown in FIG. 4. Then, still pulling from the anchor rope, the anchor starts to get up from the bottom. The pulling direction is now almost the opposite with respect to the anchor pull-down into bottom.

Figure 5:
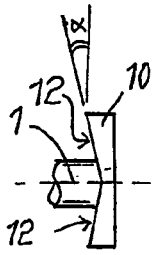
FIG. 5 is the end of the anchor shank.

When the anchor has got up a little the anchor starts, due to the centre of gravity, to turn so that the pull side of shank 1 gets up. The construction of the anchor is so made that with piece 9 against stoppers 6 the centre of gravity is still at some distance from holding block 8 towards holders 3.4 of anchor rear end. The shank end gets up and piece 9 glides simultaneously back to the pull side of the shank. In free hanging position, when piece 9 begins to move in the shank, the anchor settles so that groove 11 of piece 9 reaches to the line of stopper 7 and thus piece 9 can get quite close to the pull side of the shank. Further, exactly in the shank end, there are control surfaces 12, which turn together with corresponding control surfaces 12*a* of piece 9 and keep the anchor just in the wanted lift-up direction for pulling it up into the boat. Most suitably angle ∀ of control surfaces 12 is 15–25° as shown in FIG. 5.

Instead of the solution presented by the figures shank 1 can be furnished with a longitudinal groove or it can diverge from the round cross-section, whereby piece 9 has a corresponding hole shape or a bracket part matching in the groove. However, in all these cases piece 9 on the pull side of the shank has to be made round, that is to make turning-off possible from the angle position so that it can advance to the other end of shank 1 and back again.

The invention is not restricted to the enclosed embodiment examples but it can be modified within the inventive concept determined in the enclosed claims.

The invention claimed is:

1. An assembly used in connection with an anchor, whereby on use, the anchor comprises one or more endpieces (2) meant to penetrate into the bottom, a shank (1) from said endpiece, and fitted to the shank end a fixing means, as a holding block (8), furnished with a hole for the pulling element of the anchor, whereby the holding block (8) or similar of the pulling element is fitted to piece (9) movable along shank (1), which piece can turn around shank (1) at least in the shank end, characterized in that on anchoring the motion of piece (9) from shank (1) end towards endpiece (2) is prevented by piece (9) turning in shank (1) due to gravitation into an angle position that prevents the said motion and where holding block 8 is upwards and so the travel of piece (9) in shank (1) towards endpiece (2) is possible.

2. An assembly according to claim 1 characterized in that piece (9) moving on shank (1) is sleeve like, and in connection with the sleeve hole a longitudinal groove (11) is formed and in shank (1) a projecting stopper (7) is formed, whereby piece (9) can be shifted past stopper (7), when piece (9) is turned into an angle position so that the stopper glides in groove (11).

3. An assembly according to claim 1 characterized in that on the inner surface of piece (9) a bracket part is fitted, which has in the shank end a counter groove turning around the shank, or a reduction of the shank diameter, and the shank surface comprises a longitudinal groove, whereby piece (9) can be shifted to the other end of the shank in an angle position, that said bracket part is located in the longitudinal groove formed on the shank surface.

4. An assembly according to claim 1 characterized in that with piece (9) located in shank (1) in the tip of endpiece (2), the centre of gravity of the anchor is fitted to be in lifting block (8) of piece (9) towards the fixing point of endpiece (2).

5. An assembly according to claim 1 characterized in that there is between piece (9) and shank (1) an arrangement (10), that is inclined control surfaces (12,12*a*), which turn and keep the anchor in wanted direction, when piece (9) is in the free end of the shank when pulling it up into the vessel.

* * * * *